US008020300B2

(12) United States Patent
Kleber et al.

(10) Patent No.: US 8,020,300 B2
(45) Date of Patent: Sep. 20, 2011

(54) CAST-IN-PLACE TORSION JOINT

(75) Inventors: Richard M. Kleber, Clarkston, MI (US); Michael D. Hanna, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 986 days.

(21) Appl. No.: 11/848,732

(22) Filed: Aug. 31, 2007

(65) Prior Publication Data

US 2009/0056134 A1 Mar. 5, 2009

(51) Int. Cl.
*B21D 53/26* (2006.01)
*B60B 27/00* (2006.01)

(52) U.S. Cl. ..... 29/894; 301/105.1

(58) Field of Classification Search ..... 29/894, 29/894.011, 894.36, 894.362, 888.072, 892, 29/892.1, 892.11, 428, 458, 527.2, 527.3, 29/530; 301/105.1; 474/168; 248/562, 185; 188/218 XL, 218 R, 18 A
See application file for complete search history.

(56) References Cited

U.S. PATENT DOCUMENTS

| | | | |
|---|---|---|---|
| 974,024 | A | 10/1910 | Carter |
| 1,484,421 | A | 2/1924 | Thomspon |
| 1,989,211 | A | 1/1935 | Norton |
| 2,012,838 | A | 8/1935 | Tilden |
| 2,026,878 | A | 1/1936 | Farr |
| 2,288,438 | A | 6/1942 | Dach |
| 2,603,316 | A | 7/1952 | Pierce |
| 2,978,793 | A | 4/1961 | Lamson et al. |
| 3,085,391 | A | 4/1963 | Hatfield et al. |
| 3,127,959 | A | 4/1964 | Wengrowski |
| 3,147,828 | A | 9/1964 | Hunsaker |
| 3,292,746 | A | 12/1966 | Robinette |
| 3,378,115 | A | 4/1968 | Stephens, Ill |
| 3,425,523 | A | 2/1969 | Robinette |
| 3,509,973 | A | 5/1970 | Kimata |
| 3,575,270 | A | 4/1971 | Wagenfuhrer et al. |
| 3,774,472 | A | 11/1973 | Mitchell |
| 3,841,448 | A | 10/1974 | Norton, Jr. |
| 3,975,894 | A | 8/1976 | Suzuki |
| 4,049,085 | A | 9/1977 | Blunier |
| 4,072,219 | A | 2/1978 | Hahm et al. |
| 4,195,713 | A | 4/1980 | Hagbjer et al. |

(Continued)

FOREIGN PATENT DOCUMENTS

| | | | |
|---|---|---|---|
| CH | 428319 | A | 1/1967 |

(Continued)

OTHER PUBLICATIONS

International Search Report dated Apr. 2, 2007 for International Application No. PCT US06/29687, Publication No. WO 2007/040768; GM Global Technology Operations, Inc.

(Continued)

*Primary Examiner* — John C Hong
(74) *Attorney, Agent, or Firm* — Reising Ethington P.C.

(57) ABSTRACT

One embodiment of the invention includes a product including an annular portion including a frictional surface and a first flange portion extending from the frictional surface, wherein the first flange portion comprises a first face, a second face, and a third face; and a hub portion and a second flange portion extending from the hub portion, wherein the second flange portion engages the first face, the second face, and the third face of the first flange portion.

11 Claims, 7 Drawing Sheets

U.S. PATENT DOCUMENTS 4,250,950 A 2/1981 Buxmann et al.
4,278,153 A 7/1981 Venkatu
4,281,745 A 8/1981 Wirth
4,338,758 A 7/1982 Hagbjer
4,379,501 A 4/1983 Hagiwara et al.
4,475,634 A 10/1984 Flaim et al.
4,523,666 A 6/1985 Murray
4,529,079 A 7/1985 Albertson
4,905,299 A 2/1990 Ferraiuolo et al.
5,004,078 A 4/1991 Oono et al.
5,005,676 A 4/1991 Gassiat
5,025,547 A 6/1991 Sheu et al.
5,083,643 A 1/1992 Hummel et al.
5,115,891 A 5/1992 Raitzer et al.
5,139,117 A 8/1992 Melinat
5,143,184 A 9/1992 Snyder et al.
5,183,632 A 2/1993 Kiuchi et al.
5,184,662 A 2/1993 Quick et al.
5,259,486 A 11/1993 Deane
5,310,025 A 5/1994 Anderson
5,416,962 A 5/1995 Passarella
5,417,313 A 5/1995 Matsuzaki et al.
5,509,510 A 4/1996 Ihm
5,530,213 A 6/1996 Hartsock et al.
5,582,231 A 12/1996 Siak et al.
5,620,042 A 4/1997 Ihm
5,660,251 A 8/1997 Nishizawa et al.
5,789,066 A 8/1998 DeMare et al.
5,819,882 A 10/1998 Reynolds et al.
5,855,257 A 1/1999 Wickert et al.
5,862,892 A 1/1999 Conley
5,878,843 A 3/1999 Saum
5,927,447 A 7/1999 Dickerson
5,965,249 A 10/1999 Sutton et al.
6,047,794 A 4/2000 Nishizawa
6,073,735 A 6/2000 Botsch et al.
6,112,865 A 9/2000 Wickert et al.
6,206,150 B1 3/2001 Hill
6,216,827 B1 4/2001 Ichiba et al.
6,223,866 B1 5/2001 Giacomazza
6,231,456 B1 5/2001 Rennie et al.
6,241,055 B1 6/2001 Daudi
6,241,056 B1 6/2001 Cullen et al.
6,283,258 B1 9/2001 Chen et al.
6,302,246 B1 10/2001 Naumann et al.
6,357,557 B1 3/2002 DiPonio
6,367,598 B1 4/2002 Sporzynski
6,405,839 B1 6/2002 Ballinger et al.
6,465,110 B1 10/2002 Boss et al.
6,481,545 B1 11/2002 Yano et al.
6,505,716 B1 1/2003 Daudi et al.
6,507,716 B2 1/2003 Nomura et al.
6,543,518 B1 4/2003 Bend et al.
6,648,055 B1 11/2003 Haug et al.
6,799,664 B1 10/2004 Connolly
6,880,681 B2 4/2005 Koizumi et al.
6,890,218 B2 5/2005 Patwardhan et al.
6,899,158 B2 5/2005 Matuura et al.
6,932,917 B2 8/2005 Golden et al.
6,945,309 B2 9/2005 Frait et al.
7,066,235 B2 6/2006 Huang
7,112,749 B2 9/2006 DiPaola et al.
7,178,795 B2 2/2007 Huprikar et al.
7,219,777 B2 5/2007 Lin
7,293,755 B2 11/2007 Miyahara et al.
7,380,645 B1 6/2008 Ruiz
7,568,560 B2 8/2009 Lin
7,594,568 B2 * 9/2009 Hanna et al. ..... 188/218 XL
7,604,098 B2 10/2009 Dessouki et al.
7,644,750 B2 1/2010 Schroth et al.
7,775,332 B2 8/2010 Hanna et al.
7,836,938 B2 11/2010 Agarwal et al.
2002/0007928 A1 1/2002 Guetlbauer et al.
2002/0084156 A1 7/2002 Ballinger et al.
2002/0104721 A1 8/2002 Schaus et al.
2003/0037999 A1 2/2003 Tanaka et al.
2003/0127297 A1 7/2003 Smith et al.
2003/0141154 A1 7/2003 Rancourt et al.
2003/0213658 A1 11/2003 Baba
2004/0031581 A1 2/2004 Herreid et al.
2004/0045692 A1 3/2004 Redemske
2004/0074712 A1 4/2004 Quaglia et al.
2004/0084260 A1 5/2004 Hoyte et al.
2004/0242363 A1 12/2004 Kohno et al.
2005/0011628 A1 1/2005 Frait et al.
2005/0150222 A1 7/2005 Kalish et al.
2005/0183909 A1 8/2005 Rau, III et al.
2005/0193976 A1 9/2005 Suzuki et al.
2006/0076200 A1 4/2006 Dessouki et al.
2006/0243547 A1 11/2006 Keller
2007/0039710 A1 2/2007 Newcomb
2007/0056815 A1 3/2007 Hanna et al.
2007/0062664 A1 3/2007 Schroth et al.
2007/0062768 A1 3/2007 Hanna et al.
2007/0119667 A1 5/2007 Hanna et al.
2007/0142149 A1 6/2007 Kleber
2007/0166425 A1 7/2007 Utsugi
2007/0235270 A1 10/2007 Miskinis et al.
2007/0298275 A1 12/2007 Carter et al.
2008/0099289 A1 5/2008 Hanna et al.
2008/0185249 A1 8/2008 Schroth et al.
2009/0032569 A1 2/2009 Sachdev et al.
2009/0056134 A1 3/2009 Kleber et al.
2009/0107787 A1 4/2009 Walker et al.

FOREIGN PATENT DOCUMENTS

CN 2005/10113784X 10/2005
CN 20051113784 A 10/2005
CN 1757948 A 4/2006
CN 2863313 Y 1/2007
DE 1230274 B 12/1966
DE 24 46 938 4/1976
DE 2446938 A1 4/1976
DE 25 37 038 3/1977
DE 2537038 A1 3/1977
DE 19649919 A1 6/1998
DE 199 48 009 3/2001
DE 19948009 C1 3/2001
DE 60000008 T2 3/2002
DE 101 41 698 3/2003
DE 10141698 A1 3/2003
DE 102005048258.9 10/2005
DE 102005048258 A1 4/2006
DE 60116780 T2 11/2006
EP 0 205 713 12/1986
EP 0205713 A1 12/1986
GB 1230 274 4/1971
GB 1230274 4/1971
GB 2328952 3/1999
JP 54052576 U 4/1979
JP 57154533 9/1982
JP 57154533 A 9/1982
JP 1126434 U1 8/1989
JP 05-104567 4/1993
JP 11342461 A 12/1999
JP 2001512763 T 8/2001
JP 2003214465 A 7/2003
JP 2004011841 A 1/2004
KR 20010049837 A 6/2001
WO 9823877 A1 6/1998
WO WO 98/23877 6/1998
WO 0136836 A1 5/2001
WO WO/01/36836 5/2001
WO 2007035206 A2 3/2007

OTHER PUBLICATIONS

Omar Dessouki, George Drake, Brent Lowe, Wen Kuei Chang, General Motors Corp: Disc Brake Squeal: Diagnosis & Prevention. 03NVC-224; Society of Automotive Engineer, Inc. 2002.

Z. Wu, C. Richter, L. Menon, A Study of Anodization Process During Pore Formation in Nanoporous Alumina Templates, Journal of the Electrochemical Society, vol. 154, 2007.

W.-J. Lee, M. Alhoshan, W.H. Smyrl, Titanium Dioxide Nanotube Arrays Fabricated by Anodizing Processes, Journal of the Electrochemical Society, vol. 153, 2006, pp. B499-505.

I.V. Sieber, P. Schmuki, Porous Tantalum Oxide Prepared by Electrochemical Anodic Oxidation, Journal of the Electrochemical Society, vol. 152, 2005, pp. C639-C644.
H. Tanaka, A. Shimada, A. Kinoshita, In situ Measurement of the Diameter of Nanopores in Silicon During Anodization in Hydrofluoric Acid Solution, Journal of the Electrochemic.
L.G. Hector, Jr., S. Sheu, Focused Energy Beam Work Roll Surface Texturing Science and Technology, Journal of Materials Processing & Manufacturing Science, vol. 2, Jul. 1993.
P.N. Anyalebechi, Ungrooved Mold Surface Topography Effects on Cast Subsurface Microstructure, Materials Processing Fundamentals, TMS 2007, pp. 49-62.
F. Yigit, Critical Wavelengths for Gap Nucleation in Solidification—Part 1: Theoretical Methodology, Journal of Applied Mechanics, vol. 67, Mar. 2000, pp. 66-76.
P.N. Anyalebechi, Undulatory Solid Shell Growth of Aluminum Alloy 3003 as a Function of the Wavelength of a Grooved Mold Surface Topography, TMS 2007, pp. 31-47.
Dessouki et al., U.S. Appl. No. 10/961,813, Coulumb friction damped disc brake rotors, filed Oct. 8, 2004.
Hanna et al., U.S. Appl. No. 11/475,756, Bi-metal disc brake rotor and method of manufacturing, filed Jun. 27, 2006.
Schroth et al., U.S. Appl. No. 11/475,759, Method of casting components with inserts for noise reduction, filed Jun. 27, 2006.
Schroth et al., U.S. Appl. No. 12/025,967, Damped products and methods of making and using the same, filed Feb. 5, 2008.
Hanna et al., U.S. Appl. No. 11/440,916, Bi-metal disc brake rotor and method of manufacture, filed May 25, 2006.
Hanna et al., U.S. Appl. No. 11/554,234, Coulomb damped disc brake rotor and method of manufacturing, filed Oct. 30, 2006.
Walker et al., U.S. Appl. No. 11/926,798, Inserts with holes for damped products and methods of making and using the same, filed Oct. 29, 2007.
Hanna et al., U.S. Appl. No. 11/832,401, Damped product with insert and method of making the same, filed Aug. 1, 2007.
Hanna et al., U.S. Appl. No. 11/780,679, Method of manufacturing a damped part filed Jul. 20, 2007.
Aase et al., U.S. Appl. No. 11/969,259, Method of forming casting with frictional damping insert, filed Jan. 4, 2008.
Hanna et al., U.S. Appl. No. 12/165,729, Method for securing an insert in the manufacture of a damped part, filed Jul. 1, 2008.
Hanna et al., U.S. Appl. No. 12/165,731, Product with metallic foam and method of manufacturing the same, filed Jul. 1, 2008.
Agarwal et al., U.S. Appl. No. 11/860,049, Insert with tabs and damped products and methods of making the same, filed Sep. 24, 2007.
Hanna et al., U.S. Appl. No. 12/174,163, Damped part, filed Jul. 16, 2008.
Hanna et al., U.S. Appl. No. 12/174,223, Method of casting damped part with insert, filed Jul. 16, 2008.
Hanna et al., U.S. Appl. No. 12/183,180, Casting noise-damped, vented brake rotors with embedded inserts, filed Jul. 31, 2008.
Hanna et al., U.S. Appl. No. 12/183,104, Low mass multi-piece sound damped article, filed Jul. 31, 2008.
Golden et al., U.S. Appl. No. 12/105,411, Insert with filler to dampen vibrating components, filed Apr. 18, 2008.
Hanna et al., U.S. Appl. No. 11/440,893, Rotor assembly and method, filed May 25, 2006.
Carter, U.S. Appl. No. 11/680,179, Damped automotive components with cast in place inserts and method of making same, filed Feb. 28, 2007.
Ulicny et al., U.S. Appl. No. 12/105,438, Filler material to dampen vibrating components, filed Apr. 18, 2008.
Hanna et al., U.S. Appl. No. 12/272,164, Surface configurations for damping inserts, filed Nov. 17, 2008.
Hanna et al., U.S. Appl. No. 12/145,169, Damped product with an insert having a layer including graphite thereon and methods of making and using the same, filed Jun. 24, 2008.
Lowe et al., U.S. Appl. No. 12/174,320, Damped part with insert, filed Jul. 16, 2008.
Xia, U.S. Appl. No. 12/858,596, Lightweight brake rotor and components with composite materials, filed Sep. 20, 2007.
Dessouki et al., U.S. Appl. No. 12/178,872, Friction damped brake drum, filed Jul. 24, 2008.
Sachdev et al., U.S. Appl. No. 11/832,356, Friction welding method and products made using the same, filed Aug. 1, 2007.
Gerdemann, Steven J,; Titanium Process Technologies; Advanced Materials & Processes, Jul. 2001, pp. 41-43.
Mahoney, M. W. & Lynch S. P.; Friction-Stir Processing; 15 pages.
MPIF: All You Need to Know about Powder Metallurgy; http://www.mpif.org/IntroPM/intropm/asp?linkid=1; 8 pages.
Powder Metallurgy—Wikipedia article; http://en.wikipedia.org/wiki/Powder_metallurgy; 5 pages.
Sintering—Wikipedia article; http://en.wikipedia.org/wiki/Sintering; 2 pages.
PCT/US2008/087354 Written Opinion and Search Report; Date of Mailing: Aug. 3, 2009; 9 pages.
PCT/US2009/039839 Written Opinion and Search Report; Date of Mailing: Nov. 24, 2009; 7 pages.
PCT/US2009/048424 Written Opinion and Search Report; Date of Mailing; Dec. 28, 2009; 7 pages.
U.S. Appl. No. 12/328,989, filed Dec. 5, 2008; First Named Inventor. Patrick J. Monsere.
U.S. Appl. No. 12/420,259, filed Apr. 8, 2009; First Named Inventor. Michael D. Hanna.
U.S. Appl. No. 12/434,057, filed May 1, 2009; First Named Inventor: Chongmin Kim.
U.S. Appl. No. 12/436,830, filed May 7, 2009; First Named Inventor: James G. Schroth.
U.S. Appl. No. 12/489,901, filed Jun. 23, 2009; First Named Inventor: Michael D. Hanna.
U.S. Appl. No. 12/885,813, filed Sep. 20, 2010; First Named Inventor: Michael D. Hanna.
Chinese Patent Office First Office Action, Patent Application No. 200510113784.x, Date of Issue of OA: May 18, 2007; 41 pages.
Chinese Patent Office Second Office Action, Patent Application No. 200510113784.x, Date of Issue of OA: Feb. 15, 2008; 13 pages.
German Examination of Patent Application No. 10 2005 048 258.9; Dated Oct. 22 , 2007.
U.S. Appl. No. 12/420,259; Brake Rotor With Intermediate Portion; Filing Date: Apr. 8, 2009; Inventor: Michael D. Hanna.
U.S. Appl. No. 12/789,841; Interconnection for Cast-In-Place Components; Filing Date: May 28, 2010; Inventor: Richard M. Kleber.

* cited by examiner

CAST-IN-PLACE TORSION JOINT

TECHNICAL FIELD

The field to which the disclosure generally relates includes a product with an improved cast-in-place torsion joint and a method for producing the same.

BACKGROUND

A variety of parts such as rotors, pulleys, brake drums, transmission gears, and other parts are typically composed of single piece cast iron or steel to support heavy loads and to resist wear.

SUMMARY OF EXEMPLARY EMBODIMENTS OF THE INVENTION

One embodiment of the invention includes a product including an annular portion including a frictional surface and a first flange portion extending from the frictional surface, wherein the first flange portion comprises a first face, a second face, and a third face; and a hub portion and a second flange portion extending from the hub portion, wherein the second flange portion engages the first face, the second face, and the third face of the first flange portion.

Other exemplary embodiments of the invention will become apparent from the detailed description of exemplary embodiments provided hereinafter. It should be understood that the detailed description and specific examples, while indicating the exemplary embodiments of the invention, are intended for purposes of illustration only and are not intended to limit the scope of the claimed invention.

BRIEF DESCRIPTION OF THE DRAWINGS

Exemplary embodiments of the invention will become more fully understood from the detailed description and the accompanying drawings.

DETAILED DESCRIPTION OF EXEMPLARY EMBODIMENTS

The following description of the embodiment(s) is merely exemplary in nature and is in no way intended to limit the invention, its application, or uses.

Figure 1A:
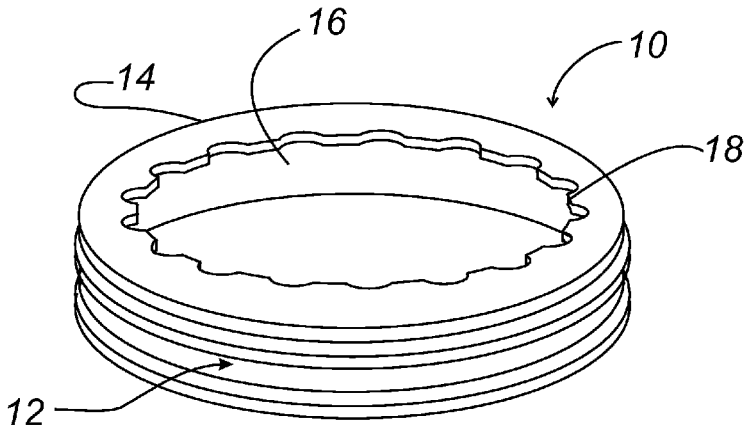
FIG. 1A is a perspective view of a brake drum according to one embodiment of the invention.

FIG. 1A shows a perspective view of a product 10. The product 10 may be for example, but is not limited to, a transmission gear, a transmission gear assembly, a rotor, a pulley, or a sprocket. In one embodiment of the invention, the product 10 may be a brake drum 10 including an annular portion 12. The annular portion 12 may include a first flange portion (annular flange portion) 14 and a frictional surface 16, where the first flange portion 14 extends from the frictional surface 16. In one embodiment, the frictional surface 16 may be located on the internal surface of the annular portion 12, and brake friction pads (not shown) may push outward on the frictional surface 16 to stop the motion of an automobile or to prevent a stopped automobile from moving. The first flange portion 14 may comprise a plurality of teeth 18 which may assist in preventing damage to the product 10 when torque is applied thereto. In another embodiment, the first flange portion 12 may include through holes (not shown) and the through holes may be located in at least one of the plurality of teeth 18. In the embodiment where the first flange portion 12 includes through holes, the first flange portion 14 may or may not include the plurality of teeth 18.

Figure 1B:
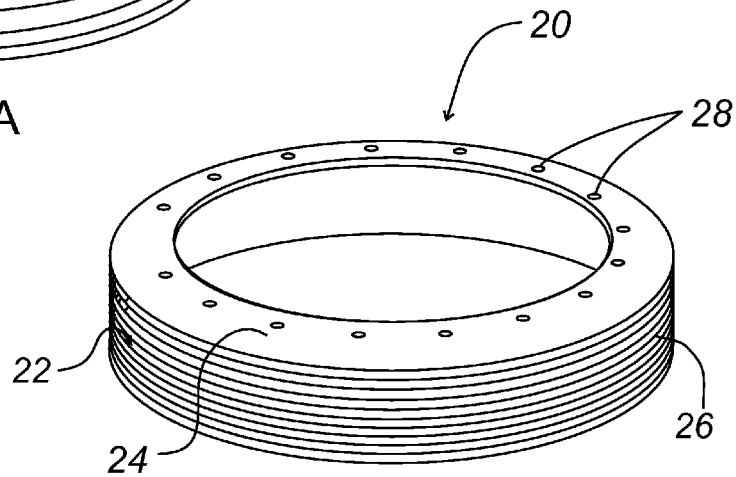
FIG. 1B is a perspective view of a pulley according to one embodiment of the invention.

In another embodiment, the product 10 may include a pulley 20. FIG. 1B shows a perspective view of a pulley 20 according to one embodiment of the invention. The pulley 20 includes an annular portion 22. The annular portion 22 includes a frictional surface 26 and a first flange portion 24, where the first flange portion 24 extends from the frictional surface 26. In one embodiment, the frictional surface 26 may be ribbed. The frictional surface 26 may be adapted for engagement by a device such as a belt (not shown). In one embodiment, the frictional surface 26 may be engaged by a belt of any known type, for example a belt having a generally rectangular cross-section or a belt having a v-shaped or triangular cross-section. A belt having a v-shaped cross section may be implemented with a notched frictional surface (not shown). In another embodiment, the pulley 20 may include through holes 28 in the first flange portion 24. In another embodiment, the first flange portion 24 may include a plurality of teeth (not shown) but no through holes 28, as shown in U.S. patent application Ser. No. 11/440,919, which is assigned to the assignee of this application. In another embodiment, the first flange portion 24 may include a plurality of teeth (not shown) and the through holes 28 may be located in at least one of the plurality of teeth.

Figure 1C:
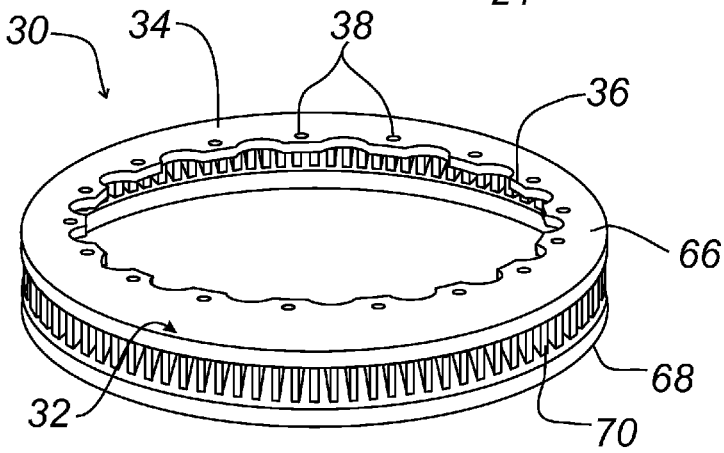
FIG. 1C is a perspective view of a rotor according to one embodiment of the invention.

In another embodiment, the product 10 may include a vehicle disk brake rotor 30. FIG. 1C shows a perspective view of a rotor 30 according to one embodiment of the invention. The rotor 30 includes an annular portion 32. The annular portion 32 includes a first portion which may include at least one of a first face 66 and a second face 68, and a first flange portion 34 extending from the first portion. The faces 66 and 68 may be adapted for engagement by a brake pad (not shown). The first flange portion 34 may extend from the first face 66. While the rotor 30 shown is vented, in other embodiments, the rotor 30 may be un-vented. In one embodiment where the rotor 30 is vented, the first face 66 and the second face 68 may be separated by a plurality of vanes 70. In one embodiment, first flange portion 34 may include a plurality of teeth 36. In another embodiment, the first flange portion 34 may include through holes 38 and the through holes 38 may be located in at least one of the plurality of teeth 36. In another embodiment, the first flange portion 34 may include the through holes 38 but not include the plurality of teeth 36. In another embodiment, the first flange portion 34 may include a plurality of teeth (not shown) but no through holes 38, as shown in U.S. patent application Ser. No. 11/220,893, which is assigned to the assignee of this application. In another embodiment, the first flange portion 34 may include the plurality of teeth 36 but not the through holes 38.

Figure 2A:
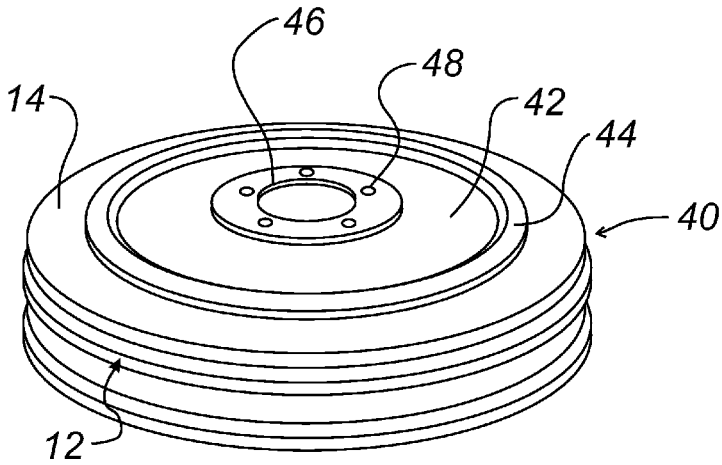
FIG. 2A is a perspective view of a brake drum assembly according to one embodiment of the invention.

In another embodiment, the automobile component 10 includes a brake drum assembly 40 shown in FIG. 2A. The brake drum assembly 40 includes the annular portion 12, the first flange portion 14 extending from the annular portion 12, a hub portion 42, and a second flange portion (hub flange portion) 44 extending from the hub portion 42. The second flange portion 44 may be constructed and arranged to engage the first flange portion 14 and thereby prevent rotation of the hub portion 42 relative to the annular portion 12. In an embodiment where the first flange portion 14 includes a plurality of teeth 18 (shown in FIG. 1A), the second flange portion 44 may also include a plurality of hub teeth (not shown) adapted to engage the complementary teeth 18. The annular portion 12 may comprise a first material. The hub portion 42 and the second flange portion 44 may comprise a second material that is lighter by volume (i.e., less dense) than the first material. The first material may comprise one of cast iron or steel. In one embodiment the second material may comprise one of aluminum, magnesium, plastic, or composite material. Aluminum may have a density of 2,700 kg $m^3$ and magnesium may have a density of 1,738 kg/$m^3$, which are significantly lighter by volume than, for example, iron having a density of 7874 kg/$m^3$. Therefore, in one embodiment, the overall weight of the drum assembly 40 is less than that of a comparable drum assembly composed entirely of cast iron or steel. In another embodiment, the hub portion 42 may also include features to attach to a vehicle axle assembly, for example a center opening 46 and a bolt hole pattern 48. In another embodiment the first material and second material are substantially the same.

Figure 2B:
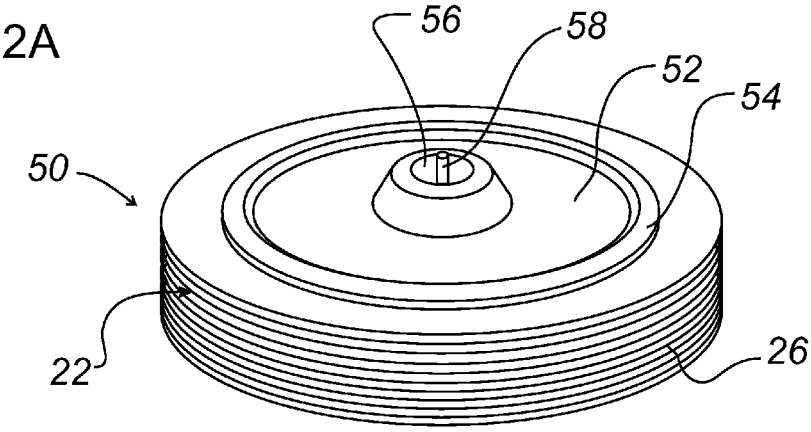
FIG. 2B is a perspective view of a pulley assembly according to one embodiment of the invention.

In another embodiment, the product 10 includes a pulley assembly 50 shown in FIG. 2B. The pulley assembly 50 includes the annular portion 22, the first flange portion 24 (shown in FIG. 1B) extending from the annular portion 22, a hub portion 52, and a second flange portion 54 extending from the hub portion 52. The second flange portion 54 may be constructed and arranged to engage the first flange portion 24 (shown in FIG. 1B) and thereby prevent rotation of the hub portion 52 relative to the annular portion 22. The through holes 28 in the first flange portion 24 (shown in FIG. 1B) may interface with the second flange portion 54 to receive a connecting post or interlocking portion or spline as described hereafter. In an embodiment where the first flange portion 24 includes a plurality of teeth (not shown), the second flange portion 54 may also include a plurality of hub teeth (not shown) adapted to engage the complementary teeth on the first flange portion 24. The annular portion 22 may comprise the first material, as described above. The pulley assembly 50 may transfer rotational energy from one device to another. An energy transfer device such as a belt engaged with the pulley assembly 50 tends to wear the friction surface over time, and therefore the first material should provide good resistance to wear and be relatively inexpensive. The hub portion 52 and the second flange portion 54 may comprise the second material, as described above. In one embodiment, the overall weight of the pulley assembly 50 is less than that of a comparable pulley assembly composed entirely of cast iron or steel. In another embodiment, the hub portion 52 may also include features to facilitate the attachment of the pulley assembly to an accessory drive component such as a shaft. These features may include, for example, a central aperture 56 and a locking element 58. The central aperture 56 may be a cylindrical or conical bored hole. The locking element 58 may be a keyhole. The features such as the central aperture 56 and the locking element 58 may be machined after the casting process.

Figure 2C:
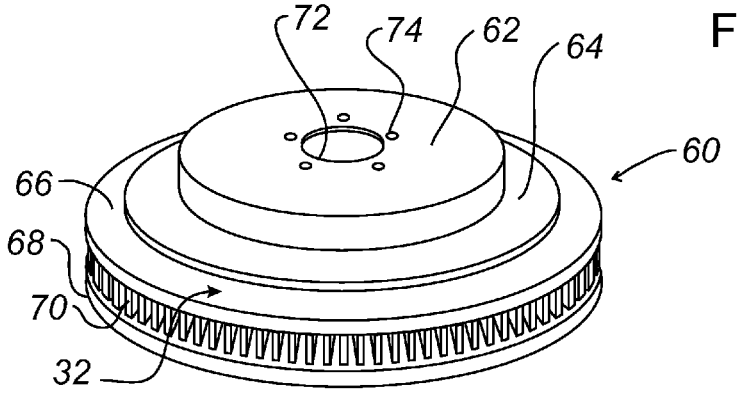
FIG. 2C is a perspective view of a rotor assembly according to one embodiment of the invention.

In another embodiment, the product 10 includes a rotor assembly 60 shown in FIG. 2C. The rotor assembly 60 includes the annular portion 32, the first flange portion 34 (shown in FIG. 1C) extending from the annular portion 32, a hub portion 62, and a second flange portion 64 extending from the hub portion 62. The second flange portion 64 may be constructed and arranged to engage the first flange portion 34 and thereby to prevent rotation of the hub portion 62 relative to the annular portion 32. In an embodiment where the first flange portion 34 includes a plurality of teeth 36 (shown in FIG. 1C), the second flange portion 64 may also include a plurality of hub teeth (not shown) adapted to engage the complementary teeth 36. The annular portion 32 may comprise the first material, as described above. The hub portion 62 may comprise the second material, as described above. The first material may provide good resistance to thermal deformation, resist wear during engagement of the brake pad (not shown) with the frictional surfaces 66 and 68, which generates heat, and be relatively inexpensive. In one embodiment, the overall weight of the rotor assembly 60 is less than that of a comparable rotor assembly composed entirely of cast iron or steel. In another embodiment, the hub portion 62 may also include features to attach the rotor assembly 60 to a vehicle axle assembly, for example a central aperture 72 and a plurality of bolt holes 74.

Figure 3A:
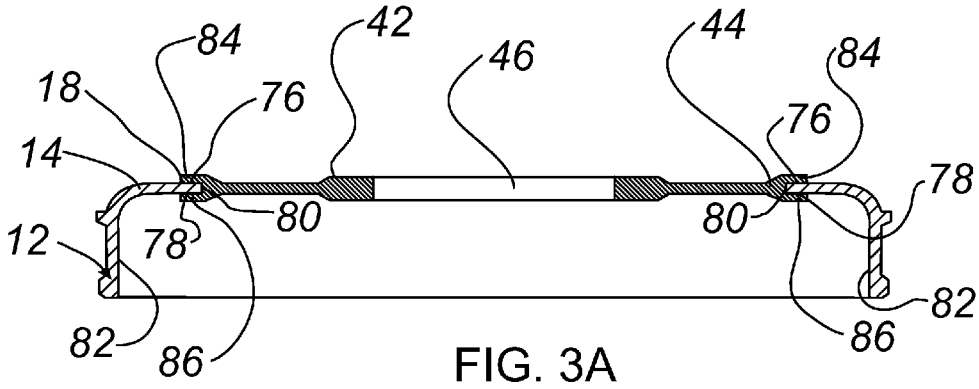
FIG. 3A is a partial sectional view of the brake drum assembly of FIG. 2A according to one embodiment of the invention.

Referring to FIG. 3A, a partial sectional view of the brake drum assembly 40 is shown. The second flange portion 44 is constructed and arranged to engage the first flange portion 14. The first flange portion 14 may extend from a friction surface 82. The first flange portion 14 may include a first face 76, a second face 78, and a third face 80. In one embodiment, the second flange portion 44 engages the first face 76, the second face 78, and the third face 80 of the first flange portion 14. The second flange portion 44 may include an outer second flange portion 84 and an inner second flange portion 86. The outer second flange portion 84 may engage the first face 76 and the inner second flange portion 86 may engage the second face 78. In one embodiment, the engagement of the second flange portion 44 with the first flange portion 14 may be described as the first flange 14 being trapped between the outer second flange portion 84 and the inner second flange portion 86. However, according to an alternate embodiment of the present invention (not shown), the geometry of the first flange portion 14 may be replaced with that of second flange portion 44 and vice versa. In other words, the first flange portion 14 may include opposing portions (not shown) configured to trap the second flange portion 44 therebetween.

Figure 3B:
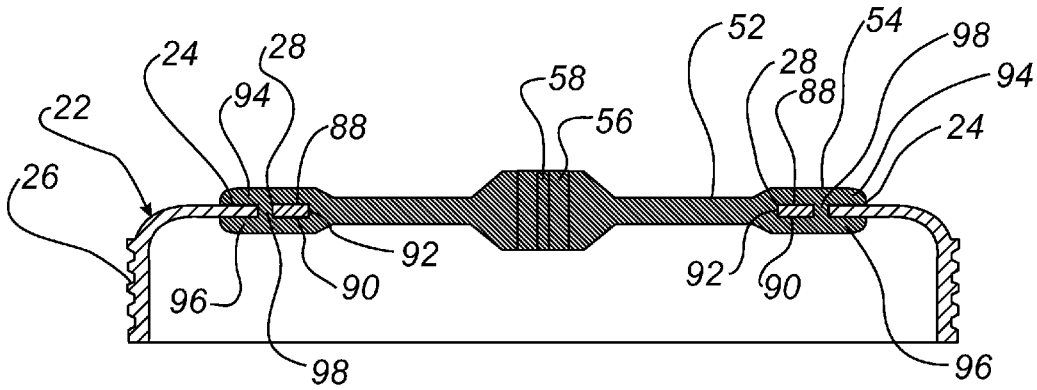
FIG. 3B is a partial sectional view of the pulley assembly of FIG. 2B according to one embodiment of the invention.
Figure 3C:
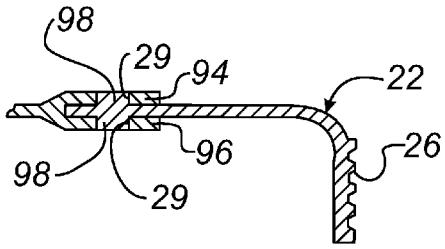
FIG. 3C is a partial sectional view of the pulley assembly of FIG. 2B according to one embodiment of the invention.
Figure 3D:
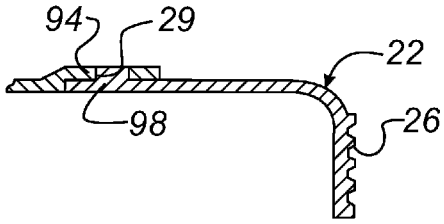
FIG. 3D is a partial sectional view of the pulley assembly of FIG. 2B according to one embodiment of the invention.

Referring to FIG. 3B, a partial sectional view of the pulley assembly 50 is shown, according to one embodiment of the invention. The hub 52 may include the central aperture 56 and the locking element 58. The second flange portion 54 is constructed and arranged to engage the first flange portion 22. The first flange portion 22 may include a first face 88, a second face 90, and a third face 92. In one embodiment, the second flange portion 54 engages the first face 88, the second face 90, and the third face 92 of the first flange portion 22. The second flange portion 54 may include an outer second flange portion 94 and an inner second flange portion 96. The outer second flange portion 94 may engage the first face 88 and the inner second flange portion 96 may engage the second face 90. In one embodiment, the second flange portion 54 also fills the through holes 28 to form connectors or connection posts (splines) 98 extending between the outer second flange portion 94 and the inner second flange portion 96. In one embodiment, the connectors 98 may provide a mechanical interface between the hub portion 52 and the annular portion 22 that is capable of transmitting the torque required in the operation of the accessory drive system. In another embodiment, the connectors 98 may be metallurgically bonded to the annular portion 22. In an alternative embodiments shown in FIGS. 3C and 3D, the connectors 98 may extend from the first face 88 or the second face 90 of the flange portion 24 into a through-hole 29 formed in at least one of the outer second flange portion 94 or the inner second flange portion 96.

Another embodiment does not include the through holes 28 and so there are no connectors 98, as shown in U.S. patent application Ser. No. 11/440,919, which is assigned to the assignee of this application. In one embodiment, the engagement of the second flange portion 54 with the first flange portion 22 may be described as the first flange portion 22 being trapped between the outer second flange portion 94 and the inner second flange portion 96. However, according to an alternate embodiment of the present invention (not shown), the geometry of the first flange portion 22 may be replaced with that of second flange portion 54 and vice versa. In other words, the first flange portion 22 may include opposing portions (not shown) configured to trap the second flange portion 54 therebetween.

Figure 3E:
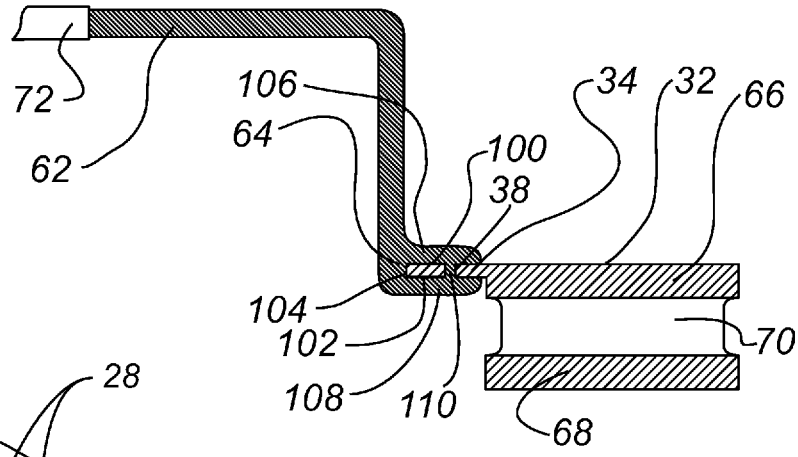
FIG. 3E is a partial sectional view of the rotor assembly of FIG. 2C according to one embodiment of the invention.

Referring now to FIG. 3E, a partial sectional view of the rotor assembly 60 is shown, according to one embodiment of the invention. The second flange portion 64 is constructed and arranged to engage the first flange portion 34. The first flange portion 34 may include a first face 100, a second face 102, and a third face 104. In one embodiment, the second flange portion 64 engages the first face 100, the second face 102, and the third face 104 of the first flange portion 34. The second flange portion 64 may include an outer second flange portion 106 and an inner second flange portion 108. The outer second flange portion 106 may engage the first face 100 and the inner second flange portion 108 may engage the second face 102. The second flange portion 64 also fills the through holes 38 to form connectors 110 between the outer second flange portion 106 and the inner second flange portion 108. The connectors 110 may provide a mechanical interface between the hub portion 62 and the annular portion 32 that is capable of transmitting the torque required. Another embodiment does not include the through holes 38 and so there are no connectors 110, as shown in U.S. patent application Ser. No. 11/220,893, which is assigned to the assignee of this application. In one embodiment, the engagement of the second flange portion 64 with the first flange portion 34 may be described as the first flange portion 34 being trapped between the outer second flange portion 106 and the inner second flange portion 108. However, according to an alternate embodiment of the present invention (not shown), the geometry of the first flange portion 34 may be replaced with that of second flange portion 64 and vice versa. In other words, the first flange portion 34 may include opposing portions (not shown) configured to trap the second flange portion 64 therebetween.

Figure 4A:
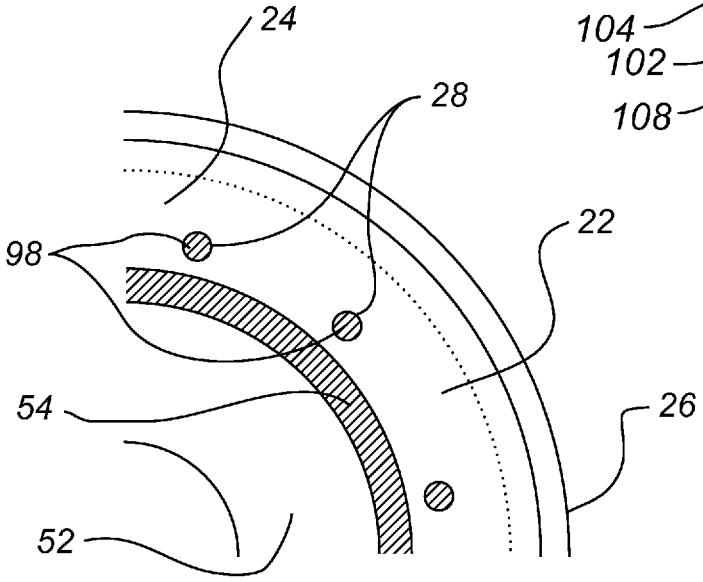
FIG. 4A is a partial sectional view of the interface of the annular portion of the pulley and the hub portion of the pulley.
Figure 4B:
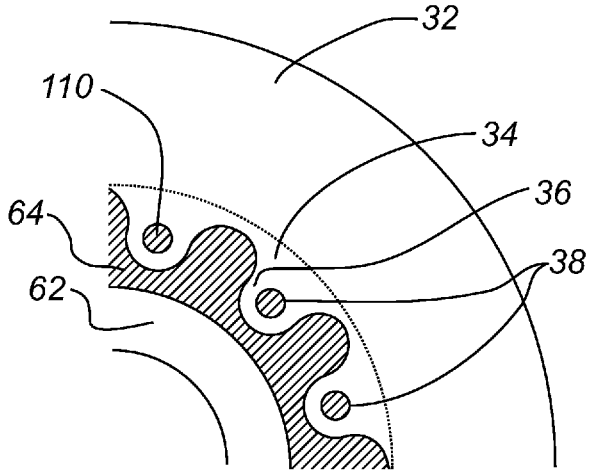
FIG. 4B is a partial sectional view of the interface of the annular portion of the rotor and the hub portion of the rotor.

Referring now to FIG. 4A, a detailed partial sectional view of the interface of the annular portion 22 of the pulley assembly 50 and the hub portion 52 of the pulley assembly 50 is provided according to one embodiment of the invention. According to another embodiment of the invention, FIG. 4B shows a detailed partial sectional view of the interface of the annular portion 32 of the rotor assembly 60 and the hub portion 62 of the rotor assembly.

Figure 5A:
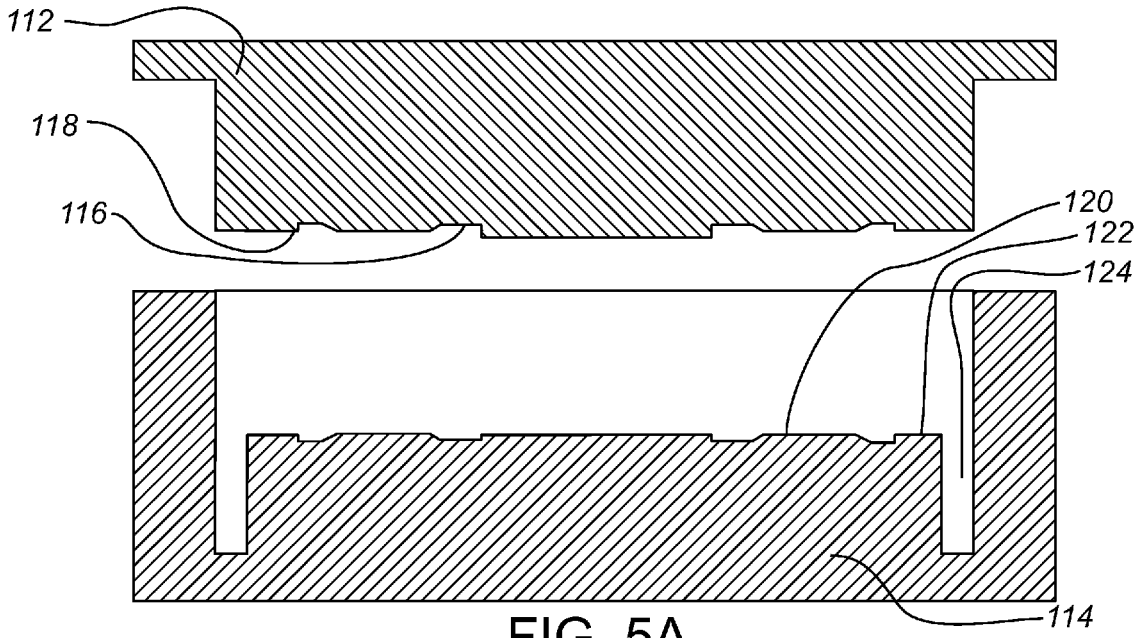
FIG. 5A illustrates a method of making the brake drum assembly of FIG. 2A according to one embodiment of the invention.

Referring now to FIG. 5A, a method of producing the brake drum assembly 40 is shown according to one embodiment of the invention. A first tool 112 and a second tool 114 are configured to manufacture the brake drum assembly 40 and are shown in an open position. The first tool 112 includes a first tool surface 116 and a first sealing lip 118. The first tool surface 116 may define the outer surfaces of the hub portion 42. The first sealing lip 118 may define the edges of the outer second flange portion 84. The second tool 114 includes a second tool surface 120, a second sealing lip 122, and an annular portion cavity 124. The second tool surface 120 may define the inner surfaces of the hub portion 42. The second sealing lip 122 may define the edges of the inner second flange portion 86. The annular portion cavity 124 may be of a size and shape to readily accept the insertion of the annular portion 12. The first tool 112 and the second tool 114 may be metallic.

Figure 5B:
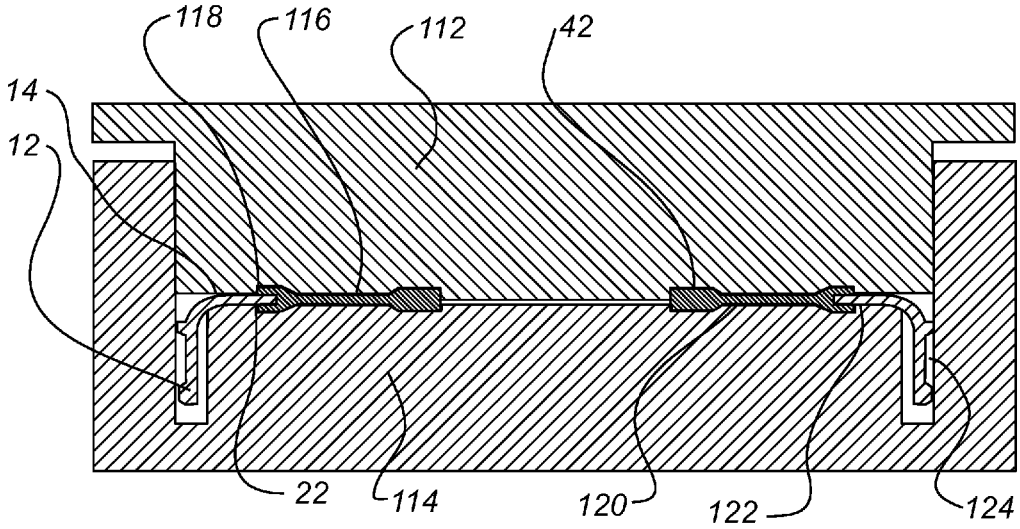
FIG. 5B illustrates a method of making the brake drum assembly of FIG. 2A according to one embodiment of the invention.

As shown in FIG. 5B, the annular portion 12 is placed in the annular portion cavity 124. The first tool 112 is then placed over the second tool 114. A compressive force is applied to the first tool 112 and the second tool 114, which in turn applies a compressive force clamping the first flange portion 14 between the first sealing lip 118 and the second sealing lip 122. The sealing lips 118 and 122 may define the perimeter of a central cavity 116 that is formed between the first tool 112 and the second tool 114. A material is then introduced into the central cavity 116 to form the hub portion 42 and the second flange portion 54 extending from the hub portion 42. The material may be a molten substance, for example molten aluminum or magnesium. The material is transferred into the central cavity 116, for example injected into the cavity 116. In another embodiment, the material is a semi-solid material and may be introduced into the central cavity 116 in accordance with the well known semi-solid forging process. The sealing lips 118 and 122 may prevent the material from leaking out of the central cavity 116. The material forms the hub portion 42, as shown in FIG. 5B. In one embodiment, the molten material forms hub teeth (not shown) which mechanically interlock with the teeth 18. In one embodiment, as the molten material comes into contact with the annular portion 12, a welding or diffusion bonding process may occur at the interface between the hub portion 42 and the annular portion 12 to further prevent relative motion therebetween. In one embodiment, the first tool 112, the second tool 114, and the annular portion 12 are maintained at a predetermined elevated temperature before the material is transferred into the central cavity 116, such that the material does not prematurely cool upon contact with a relatively cold surface. After the passing of a sufficient cooling time, the tools 112 and 114 would return to the open position as shown in FIG. 5A and the brake drum assembly 40 would be removed for further processing. Further processing may include, for example, machining features into the hub portion 42 such as the center opening 46 or the bolt hole pattern 48 shown in FIG. 2A. When the tools 112 and 114 are returned to the open position, the next annular portion 12 would be inserted into the open tooling and the manufacturing process of the brake drum assembly 40 would repeat.

In another embodiment (not shown), the hub portion 42 may be positioned in the first tool 112, the second tool 114 may be placed over the first tool 112, and a material may be introduced into a cavity formed between the tools 112 and 114 to form the annular portion 12.

Figure 6A:
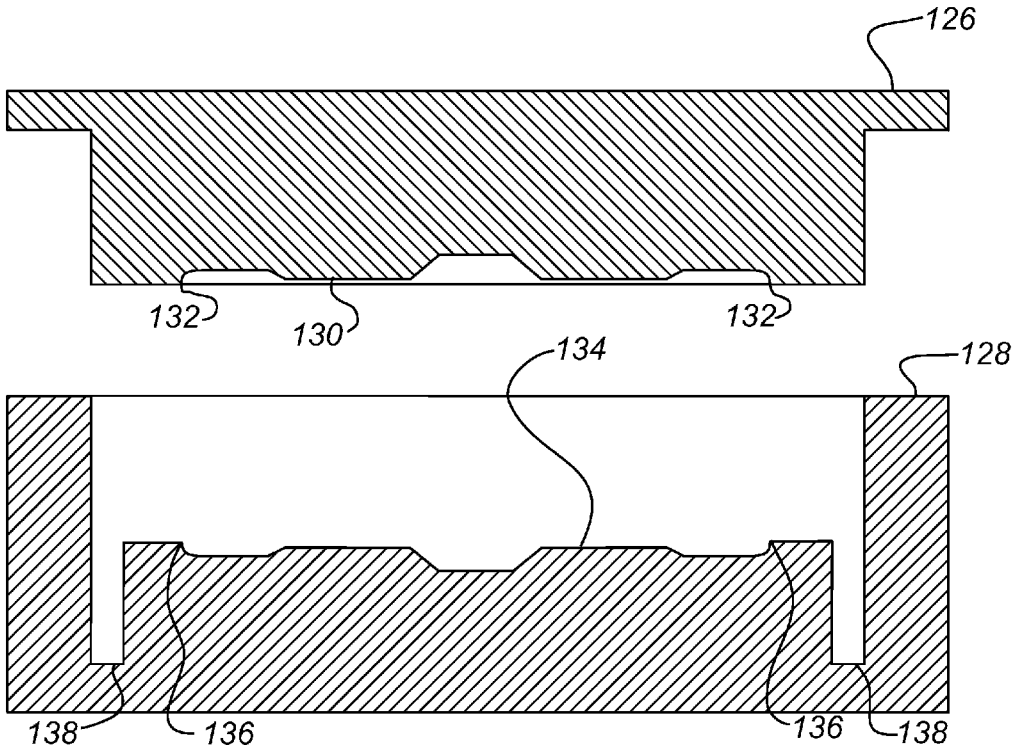
FIG. 6A illustrates a method of making the pulley assembly of FIG. 2B according to one embodiment of the invention.

Referring now to FIG. 6A, a method of producing the pulley assembly 50 is shown according to one embodiment of the invention. A first tool 126 and a second tool 128 are configured to manufacture the pulley assembly 50 and are shown in an open position. The first tool 126 includes a first tool surface 130 and a first sealing lip 132. The first tool surface 130 may define the outer surfaces of the hub portion 52 (shown in FIG. 2B and in FIG. 3B). The first sealing lip 132 may define the edges of the outer second flange portion 94 (shown in FIG. 3B). The second tool 128 includes a second tool surface 134, a second sealing lip 136, and an annular portion cavity 138. The second tool surface 134 may define the inner surfaces of the hub portion 52. The second sealing lip 136 may define the edges of the inner second flange portion 96 (shown in FIG. 3B). The annular portion cavity 138 may be of a size and shape to readily accept the insertion of the annular portion 26. The first tool 126 and the second tool 128 may be metallic.

Figure 6B:
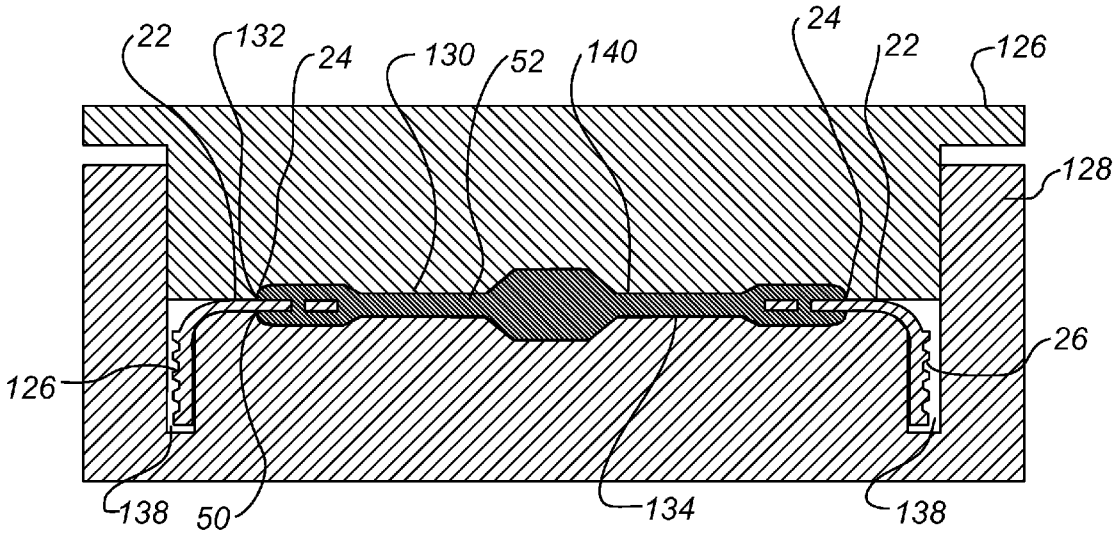
FIG. 6B illustrates a method of making the pulley assembly of FIG. 2B according to one embodiment of the invention.

As shown in FIG. 6B, the annular portion 26 is placed in the annular portion cavity 138. The first tool 126 is then placed over the second tool 128. A compressive force is applied to the first tool 126 and the second tool 128, which in turn applies a compressive force clamping the first flange portion 24 between the first sealing lip 118 and the second sealing lip 122. The sealing lips 118 and 122 may define the perimeter of a central cavity 140 that is formed between the first tool 126 and the second tool 128. A material is then introduced into the central cavity 140 to form the hub portion 52 and the second flange portion 54 extending from the hub portion 52. The material may be a molten substance, for example molten aluminum or magnesium. The material is transferred into the central cavity 140, for example injected into the central cavity 140. In another embodiment, the material is a semi-solid material and may be introduced into the central cavity 140 in accordance with the well known semi-solid forging process. The sealing lips 118 and 122 may prevent the material from leaking out of the central cavity 140. The material forms the hub portion 52 and the second flange portion 54, as shown in FIG. 6B. In one embodiment, the molten material forms hub teeth (not shown) which mechanically interlock with the complementary teeth on the first flange portion 24. In one embodiment, as the molten material comes into contact with the annular portion 26, a welding or diffusion bonding process may occur at the interface between the hub portion 52 and the annular portion 26 to further prevent relative motion therebetween. In one embodiment, the first tool 126, the second tool 128, and the annular portion 26 are maintained at a predetermined elevated temperature before the material is transferred into the central cavity 140, such that the material does not prematurely cool upon contact with a relatively cold surface. After the passing of a sufficient cooling time, the tools 126 and 128 would return to the open position as shown in FIG. 6A and the pulley assembly 50 would be removed for further processing. Further processing may include, for example, machining features into the hub portion 52 such as the central aperture 56 and the locking element 58 shown in FIG. 2B. When the tools 126 and 128 are returned to the open position, the next annular portion 26 would be inserted into the open tooling and the manufacturing process of the pulley assembly 50 would repeat.

In another embodiment (not shown), the hub portion 52 may be positioned in the first tool 126, the second tool 128 may be placed over the first tool 126, and a material may be introduced into a cavity formed between the tools 126 and 128 to form the annular portion 26.

Figure 7A:
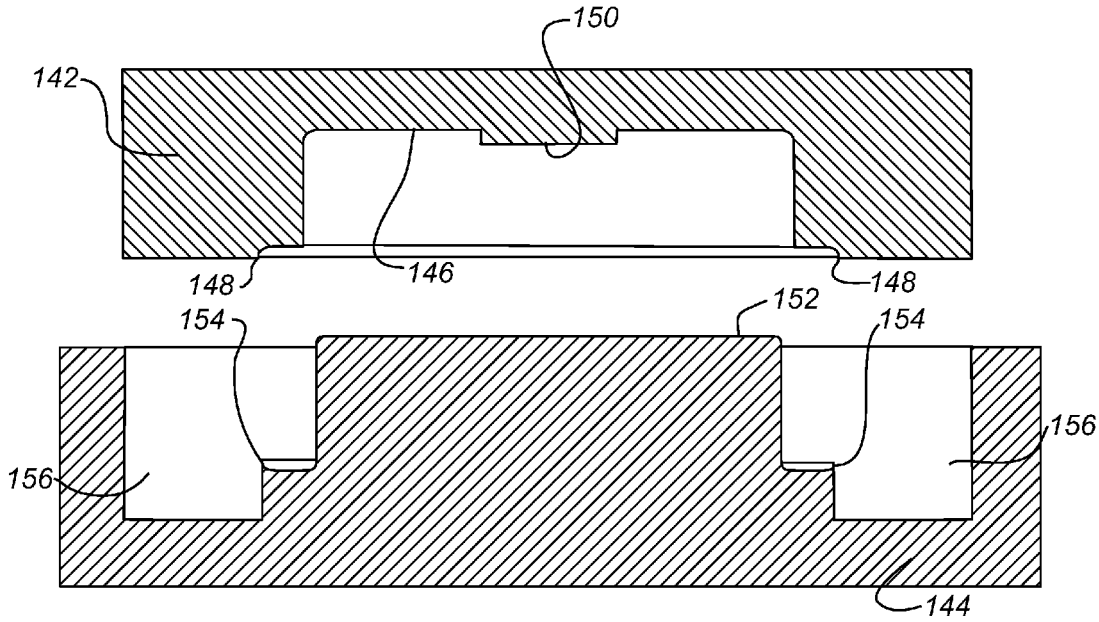
FIG. 7A illustrates a method of making the rotor assembly of FIG. 2C according to one embodiment of the invention.

Referring now to FIG. 7A, a method of producing the rotor assembly 60 is shown according to one embodiment of the invention. A first tool 142 and a second tool 144 are configured to manufacture the rotor assembly 60 and are shown in an open position. The first tool 142 includes a first tool surface 146 and a first sealing lip 148. The first tool surface 146 may define the outer surfaces of the hub portion 62 (shown in FIG. 2C and in FIG. 3E). The first sealing lip 148 may define the edges of the outer second flange portion 106 (shown in FIG. 3E). In one embodiment, the first tool 142 also includes a generally cylindrical protrusion 150 configured to produce the central aperture 72 (shown in FIG. 2C). But in other embodiments, the central aperture 72 may be produced by a subsequent machining process. In one embodiment, the plurality of bolt holes 74 (shown in FIG. 2C) may be produced by a plurality of smaller protrusions (not shown) in the first tool 142 or by a subsequent machining process.

Still referring to FIG. 7A, the second tool 144 includes a second tool surface 152, a second sealing lip 154, and an annular portion cavity 156. The second tool surface 152 may define the inner surfaces of the hub portion 62. The second sealing lip 154 may define the edges of the inner second flange portion 108 (shown in FIG. 3E). The annular portion cavity 156 may be of a size and shape to readily accept the insertion of the annular portion 32. The first tool 142 and the second tool 144 may be metallic.

Figure 7B:
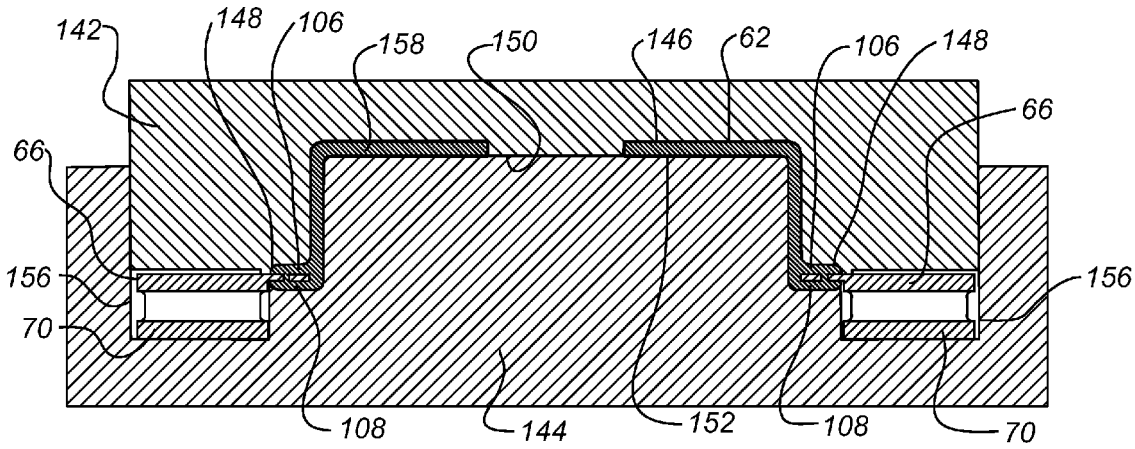
FIG. 7B illustrates a method of making the rotor assembly of FIG. 2C according to one embodiment of the invention.

As shown in FIG. 7B, the annular portion 32 is placed in the annular portion cavity 156. The first tool 142 is then placed over the second tool 144. A compressive force is applied to the first tool 142 and the second tool 144, which in turn applies a compressive force clamping the first flange portion 34 between the first sealing lip 148 and the second sealing lip 154. The sealing lips 148 and 154 may define the perimeter of a central cavity 158 that is formed between the first tool 142 and the second tool 144. A material is then introduced into the central cavity 158 to form the hub portion 62. The material may be a molten substance, for example molten aluminum or magnesium. The material is transferred into the central cavity 158, for example injected into the central cavity 158. In another embodiment, the material is a semi-solid material and may be introduced into the central cavity 156 in accordance with the well known semi-solid forging process. The sealing lips 118 and 122 may prevent the material from leaking out of the central cavity 158. The material forms the hub portion 62, as shown in FIG. 7B. In one embodiment, the molten material forms hub teeth (not shown) which mechanically interlock with the complementary teeth 36. In one embodiment, as the molten material comes into contact with the annular portion 32, a welding or diffusion bonding process may occur at the interface between the hub portion 62 and the annular portion 32 to further prevent relative motion therebetween. In one embodiment, the first tool 142, the second tool 144, and the annular portion 32 are maintained at a predetermined elevated temperature before the material is transferred into the central cavity 158, such that the material does not prematurely cool upon contact with a relatively cold surface. After the passing of a sufficient cooling time, the tools 142 and 144 would return to the open position as shown in FIG. 7A and the rotor assembly 60 would be removed for further processing. Further processing may include, for example, machining features into the hub portion 62 such as the central aperture 72 and the plurality of bolt holes 74 shown in FIG. 2C. When the tools 142 and 144 are returned to the open position, the next annular portion 32 would be inserted into the open tooling and the manufacturing process of the rotor assembly 60 would repeat.

In another embodiment (not shown), the hub portion 62 may be positioned in the first tool 142, the second tool 144 may be placed over the first tool 142, and a material may be introduced into a cavity formed between the tools 142 and 144 to form the annular portion 32.

The above description of embodiments of the invention is merely exemplary in nature and, thus, variations thereof are not to be regarded as a departure from the spirit and scope of the invention.

What is claimed is:

1. A method comprising:

providing a first tool and a second tool;

positioning in the second tool an annular portion comprising a frictional surface and a first flange portion extending from the frictional surface, wherein the first flange portion comprises a first face, a second face, and a third face, and wherein the first flange portion includes a plurality of through holes located therein;

engaging the first tool and the second tool such that a cavity is formed therebetween; and transferring a second material into the cavity to form a hub portion and to form a second flange portion extending from the hub portion and engaging the first face, the second face, and the third face of the first flange portion, and engaging the first flange portion in the through holes of the first flange portion.

2. A method as set forth in claim 1 wherein the annular portion comprises a first material, and the hub portion and the second flange portion comprise a second material, and the second material is lighter by volume than the first material.

3. A method as set forth in claim 1 wherein the first flange portion comprises a plurality of teeth and the second flange portion is configured to engage the plurality of teeth.

4. A method as set forth in claim 1 further comprising heating the first tool, the second tool, and the annular portion before transferring the second material into the cavity.

5. A method as set forth in claim 1 wherein transferring the second material into the cavity comprises one of pouring molten second material, injecting molten second material, or transferring semi-solid second material into the cavity.

6. A method as set forth in claim 1 wherein the first material comprises one of cast iron or steel.

7. A method as set forth in claim 1 wherein the second material comprises one of aluminum, magnesium, plastic, or composite material.

8. A method as set forth in claim 1 further comprising machining into the hub portion at least one of a cylindrical bored hole, a conical bored hole, a locking element, a keyhole, a central aperture, or plurality of holes.

9. A method comprising:

providing a first tool comprising a first sealing lip and providing a second tool having a second sealing lip;

positioning in the second tool an annular portion comprising a frictional surface and a first flange portion extending from the frictional surface, wherein the first flange portion comprises a first face, a second face, and a third face, and wherein the first flange portion includes a plurality of through holes located therein;

engaging the first tool and the second tool such that a cavity is formed therebetween;

heating the first tool, the second tool, and the annular portion;

applying a compressive force to draw the first tool and the second tool together and to clamp the first flange portion between the first sealing lip and the second sealing lip;

transferring a second material into the cavity to form a hub portion and to form a second flange portion extending from the hub portion and engaging the first face, the second face, and the third face of the first flange portion, and engaging the first flange portion in the through holes of the first flange portion; and wherein the annular portion comprises a first material, the hub portion and the second flange portion comprise a second material, and the second material is lighter by volume than the first material.

10. A method comprising:

providing a first tool and a second tool;

positioning in the first tool a hub portion comprising a hub flange portion, wherein the hub flange portion includes a plurality of through holes located therein;

engaging the first tool and the second tool such that a cavity is formed therebetween;

transferring a first material into the cavity to form an annular portion comprising a frictional surface and an annular flange portion extending from the frictional surface and engaging the hub flange portion, and engaging the hub flange portion in the through holes of the hub flange portion.

11. A method as set forth in claim 10 wherein the annular portion comprises a first material, the hub portion comprises a second material, and the second material is lighter by volume than the first material.

* * * * *